United States Patent [19]

Björkman

[11] Patent Number: 4,689,521

[45] Date of Patent: Aug. 25, 1987

[54] COMPACT LOW PRESSURE MERCURY VAPOR DISCHARGE LAMP

[75] Inventor: Ake Björkman, Karlskrona, Sweden

[73] Assignee: Lumalampan Aktiebolag, Karlskrona, Sweden

[21] Appl. No.: 865,062

[22] Filed: May 19, 1986

[30] Foreign Application Priority Data

May 23, 1985 [SE] Sweden ..... 8502560

[51] Int. Cl.[4] ..... H01J 63/04

[52] U.S. Cl. ..... 313/493; 313/634

[58] Field of Search ..... 313/573, 493, 485, 642, 313/634

[56] References Cited

U.S. PATENT DOCUMENTS

| | | | |
|---|---|---|---|
| 3,780,329 | 12/1973 | Otsuka et al. | 313/642 X |
| 4,277,720 | 7/1981 | Couwenberg et al. | 313/642 X |
| 4,481,442 | 11/1984 | Albrecht et al. | 313/493 |

FOREIGN PATENT DOCUMENTS

| | | | |
|---|---|---|---|
| 0151647 | 8/1985 | European Pat. Off. . | |
| 57-210559 | 12/1982 | Japan | 313/634 |
| 58-93152 | 6/1983 | Japan . | |
| 58-93153 | 6/1983 | Japan . | |
| 58-93154 | 6/1983 | Japan . | |
| 60-91549 | 5/1985 | Japan . | |

OTHER PUBLICATIONS

European Search Report, 1/86.

*Primary Examiner*—Palmer C. DeMeo
*Assistant Examiner*—Sandra L. O'Shea
*Attorney, Agent, or Firm*—Roylance, Abrams, Berdo & Goodman

[57] ABSTRACT

A compact low-pressure mercury vapor discharge lamp comprises two or more straight tubes which are interconnected by arcuate connecting means (12) to form a discharge chamber between two electrodes (9). These electrodes are located in the distal ends (2, 3) of the lamp, and the ends (2, 3) are connected in a gas-tight manner to a lamp base (8) incorporating necessary contact pins (6, 7) and electrical conductors (8). The interconnecting means (12) presents a spine (13) which extends along the means (12). When seen in cross-section, the spine (13) exhibits an acute angle which defines a condensation space for condensation of mercury vapor used in the lamp. As a result of the shape of the spine (13) the mercury vapor condenses outside the circular cross-section area (14) where the positive column is formed during operation of the lamp, the discharge current passing in this column.

9 Claims, 4 Drawing Figures

COMPACT LOW PRESSURE MERCURY VAPOR DISCHARGE LAMP

Figure 1:
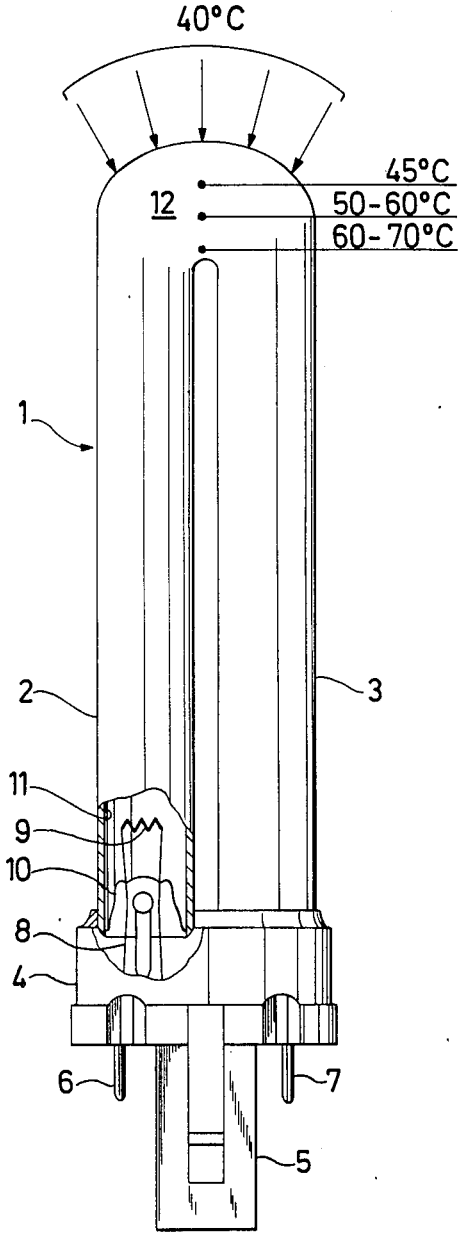

The present invention relates to a so-called compact low-pressure mercury vapour discharge lamp, i.e. a gas discharge lamp comprising two or more mutually parallel tubes which are coated internally with a fluorescent substance and joined together in the proximity of their ends to form a discharge chamber between two electrodes.

Many kinds of compact low-pressure mercury vapour discharge lamps are known to the art. Of these many known designs, there are two constructions which dominate in the case of lamps comprising solely two straight tubes. A first of these constructions can be most easily described as being of inverted U-shape with the lamp electrodes located in the free ends of the tube, these free ends being attached to a common lamp base. The second of these dominating lamps has a substantially H-shaped configuration, with the horizontal bridge placed at a very high location between the two verticals. In this lamp, the electrodes are arranged in the tube ends located furthest from the bridge. The ends of the tubes in which the electrodes are located are also fitted to a common lamp base, which incorporates a starter or ignition means and series impedance means. The tubes of both these designs are coated internally with a luminescent powder of any desired composition. This luminescent powder converts the ultraviolet light rays produced by a discharge into visible light.

Those compact low-pressure mercury discharge lamp variants which incorporate more than two straight tubes normally comprise four tubes. These tubes may be located in a single plane, or may be placed in the corners of a square, forming an imaginary cross-section at right angles to the symmetry axes of the tubes. Cross-coupling between the straight tubes is effected alternately between the tube ends located furthest away from the lamp base and the tube ends located nearest said base. Only the first and the last tubes are connected to the lamp base, and it is in these ends of the base-connected tubes that the electrodes are arranged. In this way there is formed a continuous discharge chamber through which the electric current passing between the electrodes flows when the lamp is energized. The fact that the electric current is forced to change direction when passing from one tube to another, via an interconnecting tube, has no essential significance with regard to luminous efficiency.

In compact low-pressure mercury vapour discharge lamps, as with other low-pressure gas discharge lamps, there is formed between the electrodes a positive column of light arc which passes in the lamp through a rare gas mixed with mercury vapour. The gas pressure in such a compact lamp is held beneath 500 Pascal (Pa), and at operating temperatures the mercury partial pressure constitutes less than 1 Pa of this value.

The function of the rare gas is to facilitate lamp ignition at a reasonable start voltage, and to increase the probability of collision between the electrons and mercury atoms when the lamp is energized. The low mercury vapour pressure prevailing at 40° C. provides the optimum for producing the mercury resonance lines, which lie within the ultraviolet range, namely at 253.7 and 185 nanometers (nm). If a low-pressure mercury vapour discharge lamp contained solely mercury vapour, the electrons would collide practically solely with the tube walls and mercury atoms, where with in the absence of luminescent powder the electron energy would be converted into heat and not into light.

A compact low-pressure mercury vapour discharge lamp of the aforedescribed H-configuration is known from NL-B 7902572, whereas a lamp of the inverted U-shaped variant is described in EP-A-0061758 (Application Ser. No. 82102636.6). It is clearly stated in this latter publication that the object of the invention described therein is to provide a compact low-pressure mercury vapour lamp in which the glass walls of the lamp have a form such that a desired low temperature is obtained within certain sections during operation, for the purpose of achieving a balanced mercury vapour pressure.

A prime object of the present invention is to provide a compact low-pressure mercury vapour discharge lamp of such nature that the mercury partial pressure in the discharge chamber, while the lamp is energized, is maintained at a level which provides maximum effect with respect to the radiation generated by the discharge at the mercury resonance lines. The lamp shall also be constructed to be effective in preventing power losses due to constrictions occurring in the path of the discharge current.

These objects are achieved by means of the invention defined and characterized in the following claims.

The invention is based on the concept that in a discharge chamber in the embodiment used in compact low-pressure mercury vapour lamps, the negative space charge is concentrated at the tube walls and a positive column is formed between the electrodes with the space charge zero along its axis. The discharge between the cathode and anode regions is unitary in the axial direction, at each moment following ignition of the lamp. Positive ions and electrons are formed simultaneously with the discharge. These are concentrated at the tube walls by diffusion. Since the column is axially unitary, no particle losses are experienced in the axial direction. During this diffusion process, the electrons move much more rapidly than the positive ions, due to the smaller mass of the electrons, and hence a positive space charge is developed from the centre of the tube outwards. This improves conditions for discharge in the positive column, and therewith increases the power in the ultraviolet radiation.

In order to allow the discharge to propagate naturally in the lamp, this propagation taking the form of a wavefront of circular configuration in cross-section, the novel lamp according to the invention is constructed to present a mercury condensation section along a part of the positive column without encroaching upon the column axially in a manner to pinch the circular propagation front in a radial direction, this radial propagation being a requisite for optimum propagation. This has been achieved in practice by giving the discharge chamber of the lamp a U-shaped configuration, the cylindrical peripheral surface of the curved tube section between the two straight legs of the chamber being drawn from its circular cross-sectional shape in the part having the largest radius of curvature, to form a spine. This spine extends substantially around the whole of the curved tube section.

The spine extending around the U-bend of a compact gas discharge lamp is suitably given an angle of 90° or less when seen in the cross-sectional plane of the tube. In this way there is formed in the tube bend a space which is located laterally of the positive column, and in which the mercury condensation temperature at the pressure prevailing in the lamp can be kept constant. Expressed differently, it can be said that the length of the compact mercury vapour discharge lamp at different wattages is selected so that the temperature, which in regions in the proximity of the electrodes can reach above 70° C., along the spine lies close to 40° C. when the lamp operates at normal room temperature. As a result hereof the mercury partial pressure will be less than 1 Pa, in the range of $4\times10^{-3}$ torr to $7.5\times10^{-3}$ torr, or about $5\times10^{-3}$ torr, which is the pressure at which the relative efficiency for the generation of resonance radiation in mercury vapour by the light arc culminates. At lower mercury partial pressure the mercury atoms are spaced too widely apart, resulting in fewer collisions between the atoms and electrons and hence also in fewer excited photons or a lower intensity in the ultraviolet radiation. At higher mercury vapour partial pressures, the mercury atoms are so dense that the number of collisions becomes excessive and electrons rebound which also results in fewer excited photons.

Figure 2A:
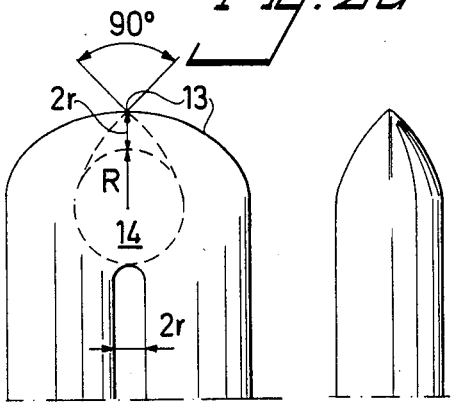
Figure 2B:
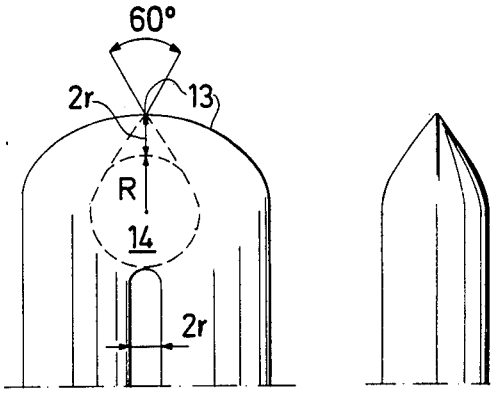
Figure 3:
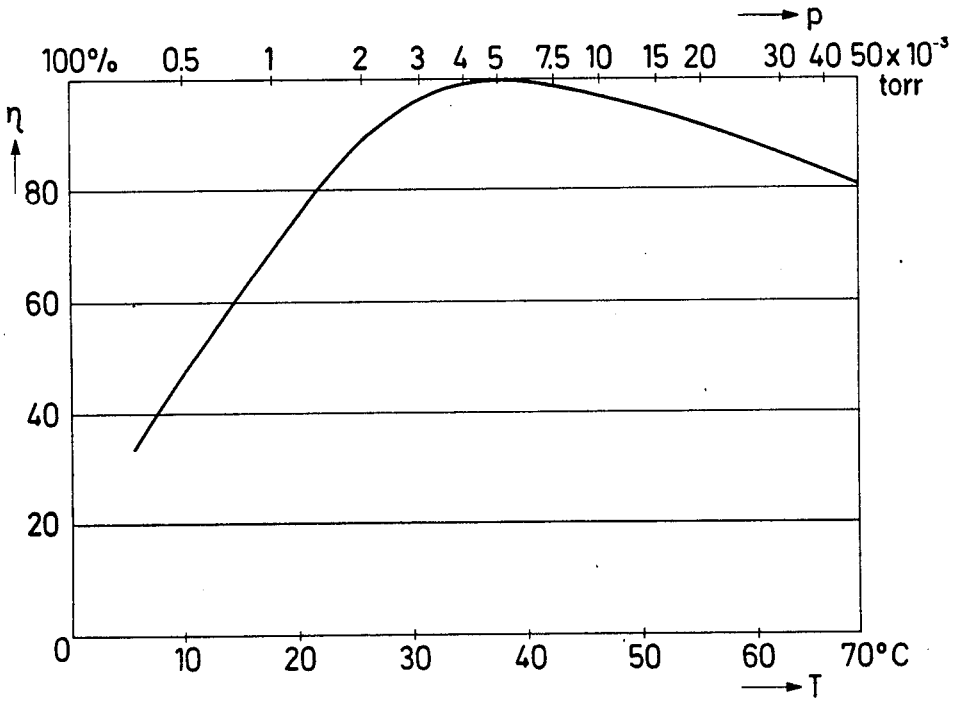

A preferred embodiment of the invention will now be described with reference to the accompanying drawings, in which FIG. 1 is a partly cut-away view of a compact low-pressure mercury vapour discharge lamp;

FIG. 2*a* is a schematic illustration of the curved part of a lamp, showing a possible spine angle;

FIG. 2*b* is a schematic illustration of the curved part indicating another spine angle; and FIG. 3 is a diagram which illustrates the relative efficiency for generating resonance radiation in mercury vapour as a function of lowest temperature within a discharge lamp (bottom scale) and corresponding mercury vapour pressure (top scale).

In its simplest form the compact mercury vapour discharge lamp comprises solely a U-shaped glass tube 1, the ends 2 and 3 of which are connected in a gas-tight manner to a lamp base 4. The base incorporates a non-circular housing 5 which is located on the side of the lamp base remote from the glass tube 1 and which encloses a starter and requisite series impedance means. The lamp base 4 is also provided with two contact pins, 6,7 for connecting the lamp electrically to a lamp holder.

Conductors 8 extend from the pins 6,7 to lamp electrodes 9. These conductors 8, and corresponding return-feed conductors are fused to a glass stem 10 located at each end 2,3, said stems being subsequently fused to the ends 2,3 of the tube 1. At least one of the stems 10 is provided with a pump pipe (not shown) for evacuating the tube 1, purging the same with an inert gas and filling the tube with rare gas.

The lamp or tube 1 is coated internally with one or more fluorescent layers 11, effective to convert to visible light the ultraviolet radiation formed by the light arc travelling between the electrodes when the lamp is switched on. The layer 11 may be of a two or three band type, or have some other composition, depending on the colour and temperature desired of the light emitted by the lamp. The coating composition can be varied within wide limits, and the rare gas filling may be varied between pure argon and argon admixed in various quantities with various other gases, for example 85% argon and 15% neon, or 20% argon and 80% krypton 10–20% argon and 90–80% krypton.

The novel characteristic features of the invention lie in the design of the region of the curved part 12 of the tube 1 in which during continued operation of the lamp, the temperature is maintained at such a low level (40° C.) that the mercury introduced into the tube 1 obtains the desired partial pressure according to the diagram presented in FIG. 3. FIG. 1 shows the temperatures prevailing at different heights in the curved part 12 of the tube. FIGS. 2*a* and 2*b* show that the cross-sectional shape of the curved part 12 departs from the circular cross-sectional shape of the remainder of the tube 1. Instead, the outwardly turned part of the peripheral tube surface in the region of the curve has been drawn out into a spine 13.

Referring to FIGS. 2*a* and 2*b*, the spine 13 is formed to a given height above the circular field 14, which has a radius and which corresponds to the cross-sectional area of the tube 1 when imagining said area to be inserted into the curved tube part and touching the inner radius of curvature thereof. It has been found that an advantage is gained when the height of the spine 13 above the field 14 is approximately twice the radius of curvature of the inner curved surface of the curved tube part 12. This relationship is indicated by the two appearances of the dimension "2r" in each of FIGS. 2*a* and 2*b*. This enables an efficient volume to be obtained around the whole of the curved tube part 12, where an electron concentration affords an advantageous negative space charge. This also leaves the whole of the circular field 14 free for the positive column, in which the discharge takes place.

The spine 13 has been found to be a beneficial solution to the problem of confining the condensation of mercury vapour, inasmuch as the condensation is distributed over a sufficiently long distance parallel with the positive columns for the optimum mercury vapour pressure to be maintained throughout the whole of the discharge chamber. In order to avoid practically all disturbances in the generation of ultraviolet radiation in the mercury resonance lines, it has been found that the apex angle of the spine should lie between 60° and 90°. A 90 degree angle is indicated in FIG. 2*a* and a 60degree angle is indicated in FIG. 2*b*, the designation being turned in the drawings so as to appear on the plane of the paper. At angles greater than 90° disturbances begin to occur in the positive column, whereas at angles smaller than production on problems of a technical nature occur, i.e., it is difficult to blow out a more acute spine in production machines. With those qualities or grades of glass used hitherto the range of 70°–80° has been found to be an optimum with regard to the technical aspects of production. Although it is possible to produce a spine 13 having an apex angle more acute than 60° with other grades of glass, the temperature on the inside of the spine will be lower than 40° C., which is not desirable.

In the case of compact mercury vapour discharge lamps comprising more than two straight tube sections, the portions joining said sections may all have the form of the curved part 12 with spine 13. Otherwise only one or two of the interconnecting portions are provided with spine 13 for the condensation of mercury vapour.

I claim:

1. A compact mercury vapour discharge lamp comprising at least two mutually parallel straight tubes which are joined together by interconnecting means at one end thereof and which are internally coated with fluorescent substance (11) and together form a discharge chamber between two electrodes (9) placed in the free ends (2,3) of said tubes, said ends being connected in gas-tight manner to a common lamp base (4), characterized in that the interconnecting means (12) between the straight tubes presents in cross-section a spine (13) which extends along the interconnecting means on the side thereof remote from the lamp base (4), thereby to enlargen the circular cross-section (14) of the discharge chamber along said interconnecting means (12).

2. A lamp according to claim 1, characterized in that the spine (13) is pointed along a major part of the interconnecting means (12), to an angle of between 60° and 90°, preferably 70°–80°.

3. A lamp according to claim 1, characterized in that the spine (13) is located at a height above the outer periphery of the area of circular cross-section (14) corresponding to twice the radius of the inner arc of curvature through which the interconnecting means (12) passes between the two straight tubes.

4. A lamp according to claim 1, characterized in that the length of the straight tubes is adapted to the wattage consumed by the lamp, so that the temperature along the spine (13) will not exceed 40° C. when the lamp is energized.

5. A lamp according to claim 1, characterized in that the lamp is filled with rare gas, preferably pure argon, to a pressure of below 500 Pa.

6. A lamp according to claim 1, characterized in that it has a rare gas filling comprising 10–20% argon and 80–90% krypton.

7. A lamp according to claim 1, characterized in that it has a rare gas filling comprising 85% argon and 15% neon.

8. A lamp according to claim 1, characterized in that it contains mercury which, when the lamp is energized, is vaporized to a partial pressure of between $4\times10^{-3}$ torr and $7.5\times10^{-3}$ torr.

9. A lamp according to claim 1, wherein said spine is defined by a relatively sharp edge.

* * * * *